US011079178B2

(12) United States Patent
Allen

(10) Patent No.: US 11,079,178 B2
(45) Date of Patent: Aug. 3, 2021

(54) CAP DRYING APPARATUS AND SYSTEMS AND METHODS THEREOF

(71) Applicant: Allen Research Tech-Services, Inc., Tyrone, GA (US)

(72) Inventor: Todd Renell Allen, Tyrone, GA (US)

(73) Assignee: ALLEN RESEARCH TECH-SERVICES, INC., Tyrone, GA (US)

( * ) Notice: Subject to any disclaimer, the term of this patent is extended or adjusted under 35 U.S.C. 154(b) by 160 days.

(21) Appl. No.: 16/587,884

(22) Filed: Sep. 30, 2019

(65) Prior Publication Data

US 2020/0103167 A1 Apr. 2, 2020

Related U.S. Application Data

(60) Provisional application No. 62/739,527, filed on Oct. 1, 2018.

(51) Int. Cl.

| | |
|---|---|
| ***F26B 3/34*** | (2006.01) |
| ***A42B 1/002*** | (2021.01) |
| ***D06F 57/00*** | (2006.01) |

(52) U.S. Cl.

CPC ..... *F26B 3/343* (2013.01); *A42B 1/002* (2013.01); *D06F 57/00* (2013.01)

(58) Field of Classification Search

CPC . F26B 3/00; F26B 3/343; A42B 1/002; A42B 1/00; D06F 57/00

USPC ..... 34/103

See application file for complete search history.

(56) References Cited

U.S. PATENT DOCUMENTS

| | | | | |
|---|---|---|---|---|
| 3,188,752 A | | 6/1965 | Skinner | |
| 3,645,007 A | * | 2/1972 | Scott | A45D 20/44 34/60 |
| 3,757,429 A | | 9/1973 | Sumino | |
| 3,958,340 A | | 5/1976 | Meyers | |
| 4,301,601 A | * | 11/1981 | Carr | A45D 2/00 132/228 |
| 5,412,928 A | * | 5/1995 | Reithel | A47L 23/205 34/104 |
| 5,592,750 A | * | 1/1997 | Eichten | D06F 59/02 223/70 |
| 5,651,190 A | * | 7/1997 | Sanders | A45D 20/18 34/101 |
| 6,327,792 B1 | * | 12/2001 | Hebert | A43D 3/1491 34/104 |

(Continued)

FOREIGN PATENT DOCUMENTS

CA 2526367 A1 * 4/2007 ..... A61L 2/18

*Primary Examiner* — Stephen M Gravini

(74) *Attorney, Agent, or Firm* — Leason Ellis LLP

(57) ABSTRACT

The present application provides a cap drying apparatus and a method for drying a cap. The apparatus includes a base console having an inlet and a fan. The inlet receives an air stream from outside of the base console. The apparatus also includes an air supply conduit that is fluidly connected to the inlet and receives the air stream via operation of the fan. The apparatus further includes a mounting head having a distribution chamber and an outer portion comprising a plurality of air channels. The distribution chamber receives the air stream from the air supply conduit and disperses the air stream through the air channels and out of the mounting head. A cap securely fits on the outer surface of the mounting head, and the air stream dispersed through the air channels dries the cap.

15 Claims, 6 Drawing Sheets

(56) References Cited

U.S. PATENT DOCUMENTS

| | | | | |
|---|---|---|---|---|
| 6,553,687 | B1 * | 4/2003 | Leamon, Jr. | A42B 3/006 34/103 |
| 6,796,053 | B2 * | 9/2004 | Lurie | A47L 23/20 34/104 |
| 6,880,711 | B2 * | 4/2005 | Collier | A47G 25/0671 211/85.3 |
| 8,898,929 | B2 * | 12/2014 | Stewart | D06F 59/04 34/381 |
| 8,955,234 | B2 * | 2/2015 | Williams | F26B 21/001 34/105 |
| 8,966,781 | B1 * | 3/2015 | McKernan | A61L 2/16 34/105 |
| 9,072,359 | B2 | 7/2015 | Agoro | |
| 9,103,588 | B2 * | 8/2015 | Williams | F26B 9/003 |
| 9,557,106 | B2 * | 1/2017 | Stewart | D06F 59/04 |
| 10,689,793 | B2 * | 6/2020 | Glass | A47B 61/003 |
| 10,961,655 | B2 * | 3/2021 | Hinkey | F26B 21/001 |
| 2007/0086914 | A1 * | 4/2007 | Antinozzi | A61L 2/18 422/28 |
| 2020/0103167 | A1 * | 4/2020 | Allen | F26B 21/004 |

* cited by examiner

CAP DRYING APPARATUS AND SYSTEMS AND METHODS THEREOF

CROSS-REFERENCE TO RELATED APPLICATIONS

This application is based on and claims priority to U.S. Provisional Patent Application Ser. No. 62/739,527, filed on Oct. 1, 2018, which is hereby incorporated by reference as if set forth in its entirety herein.

TECHNICAL FIELD

The present application relates generally to a cap drying apparatus. More specifically, the present application relates to cap drying apparatus configured to securely hold a cap and dry it via a plurality of air channels.

BACKGROUND

Caps or hats are worn in a variety of settings and are useful for protecting the wearer's head from the elements such as sunlight, wind, or cold. Hats, however, can quickly become soiled with everyday use due to the accumulation of dirt as well as the perspiration of the user. While products have been developed to help wash hats, those hats oftentimes lose their shape or shrink in size when dried in a clothes dryer. Although a hat can also be left to dry outside via the air, such a process can be time consuming and can still result in a hat that has lost its original shape and is wrinkled.

As such, there is a need for an efficient way for drying a hat while maintaining its original shape and size.

SUMMARY

In a first aspect, a cap drying apparatus is provided. The cap drying apparatus includes a base console having at least one air inlet and a fan, where the at least one air inlet is configured to selectively receive an air stream from outside of the base console. The cap drying apparatus also includes an air supply conduit fluidly connected to the at least one air inlet and configure to selectively receive the air stream via operation of the fan. The cap drying apparatus also includes a mounting head having an inner air distribution chamber and an outer portion comprising a plurality of air channels. The air channels are in fluid connection with the inner air distribution chamber. The inner air distribution chamber is fluidly connected to the air supply conduit and configured to receive the air stream from the air supply conduit. The inner air distribution chamber is also configured to disperse the received air stream through the plurality of air channels and out of the mounting head. The mounting head is sized and shaped such that a cap securely fits on its outer surface.

In another aspect, the mounting head is adjustable in size and shape, and configured to securely fit hats of a various sizes on the outer surface of the mounting head.

In another aspect, the fan is a reversible fan that is configured to either force air from the air inlet into the air supply conduit and subsequently into the inner air distribution chamber or to force air out of the inner air distribution chamber into the air supply conduit and subsequently into the air inlet. In another aspect, the fan is configured to run at a plurality of different speeds.

In another aspect, the cap drying apparatus further includes a deodorizing chamber in fluid communication with the air inlet and configured to receive a deodorizing substance, wherein the air stream passing through the air inlet entrains at least a portion of the deodorizing substance.

In another aspect, the cap drying apparatus further includes a second mounting head, wherein the mounting head and the second mounting head are selectively removable from the cap drying apparatus. In a further aspect, the second mounting head is of a different size than the mounting head.

In a second aspect, a cap drying apparatus is provided, which includes a base console, an air supply conduit, and a plurality of selectively removable mounting heads. The base console includes at least one air inlet and a fan. The at least one air inlet is configured to selectively receive an air stream from outside of the base console. The air supply conduit is fluidly connected to the at least one air inlet and configured to selectively receive the air stream of air via operation of the fan. The plurality of selectively removable mounting heads have varying sizes, and each includes an inner air distribution chamber and an outer portion comprising a plurality of air channels. The air channels are in fluid connection with the inner air distribution chamber. The inner air distribution chamber is fluidly connected to the air supply conduit and configured to receive the air stream from the air supply conduit. The inner air distribution chamber is also configured to disperse the received air stream through the plurality of air channels and out of the mounting head. Each mounting head is respectively sized and shaped such that respective caps of varying sizes and shapes securely fit on their respective outer surfaces.

In another aspect, the fan is a reversible fan that is configured to either force air from the air inlet into the air supply conduit and subsequently into the inner air distribution chamber or to force air out of the inner air distribution chamber into the air supply conduit and subsequently into the air inlet.

In another aspect, the cap drying apparatus also includes a deodorizing chamber in fluid communication with the air inlet and configured to receive a deodorizing substance, wherein the air stream passing through the air inlet entrains at least a portion of the deodorizing substance. In another aspect, the fan is configured to run at a plurality of different speeds.

In a third aspect, a method for drying a cap is provided. In the method, a cap drying apparatus is provided. The cap drying apparatus includes a base console having at least one air inlet and a fan, where the at least one air inlet is configured to selectively receive an air stream from outside of the base console. The provided cap drying apparatus also includes: an air supply conduit fluidly connected to the at least one air inlet; and a mounting head having an inner air distribution chamber and an outer portion comprising a plurality of air channels. The air channels are in fluid connection with the inner air distribution chamber, and the inner air distribution chamber is fluidly connected to the air supply conduit.

As a further aspect of the method, a cap is securely fastened to the outer surface of the mounting head. The fan of the base console is then initiated. Via the fan, the air stream received by the air inlet is transferred to the air supply conduit and subsequently to the inner air distribution chamber. The air stream received by the inner air distribution chamber is dispersed through the plurality of air channels. As such, the cap is dried via the air stream that passes through the plurality of air channels.

In another aspect of the method, a deodorizing substance is loaded into a deodorizing chamber of the cap drying apparatus. The air stream entrains at least a portion of the deodorizing substance as the air stream is transferred into the air supply conduit.

In another aspect of the method, the mounting head is selectively removable. Further, the step of providing the cap drying apparatus includes securing the mounting head to a neck portion of the cap drying apparatus, which is connected to the base console.

In another aspect of the method, the mounting head is adjustable in size, and further comprising the step of adjusting the size of the mounting head to fit a size of the cap.

These and other aspects, features, and advantages can be appreciated from the accompanying description of certain embodiments and the accompanying drawing figures and claims.

BRIEF DESCRIPTION OF THE DRAWING FIGURES

DETAILED DESCRIPTION OF CERTAIN EMBODIMENTS

The present application describes cap drying apparatuses and methods for drying a cap. The present application targets, among other things, challenges regarding the efficiency of drying a cap or hat, while also maintaining its shape and structure.

In one or more embodiments, the cap drying apparatus of the present application includes a base console having at least one air inlet and a fan, where the at least one air inlet is configured to receive an air stream from outside of the base console. The cap drying apparatus also includes an air supply conduit that is fluidly connected to the air inlet and configured to receive the air stream as the fan is operated. The cap drying apparatus can also include a mounting head. The mounting head can comprise an inner air distribution chamber and an outer portion that includes a plurality of air channels. The air channels are in fluid connection with the inner air distribution chamber, and the inner air distribution chamber is in fluid connection with the air supply conduit. The cap to be dried can be securely fastened to the outer surface of the mounting head during operation. The mounting head can be adjustable in size and shape in order to accommodate cap or hats of different sizes and structures. The inner air distribution chamber selectively disperses the received air stream through the plurality of air channels and out of the mounting head such that the air comes into contact with the cap secured on the mounting head, and thereby dries the cap.

The cap drying apparatus of the present application can be used to dry caps or hats that become wet after washing/laundering, cleaning, perspiration, or being exposed to other forms of moisture or liquids (e.g., rain, snow). When the cap drying apparatus is not activated, it can also act as an apparatus for resting or storing a cap when it is not being worn by the user.

The referenced cap drying apparatuses and methods for drying a cap are now described more fully with reference to the accompanying drawings, in which one or more illustrated embodiments and/or arrangements of the systems and methods are shown. The apparatuses and methods of the present application are not limited in any way to the illustrated embodiments and/or arrangements. It should be understood that the apparatuses and methods as shown in the accompanying figures are merely exemplary of the apparatuses and methods of the present application, which can be embodied in various forms as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods.

Figure 1:
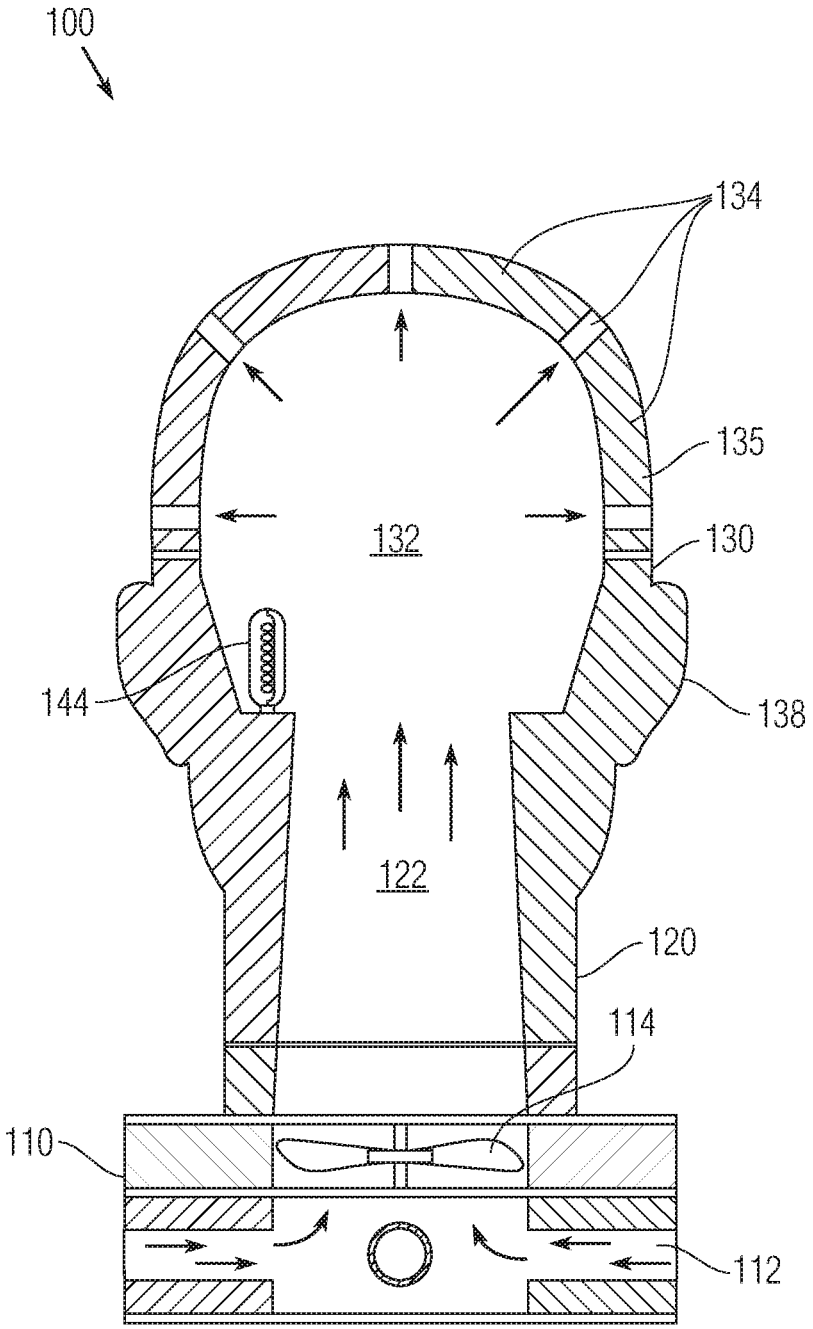
FIG. 1 shows a cross-sectional view of a cap drying apparatus in accordance with one or more embodiments.

FIG. 1 displays a cross-sectional diagram of an exemplary cap drying apparatus 100. In one or more embodiments, the cap drying apparatus can be at least partially made of plastic. In one or more embodiments, the cap drying apparatus can be made of any number of suitable materials, including but not limited to plastic, glass, clay, gypsum or other minerals, wood, composite materials, or any combination thereof.

The cap drying apparatus includes a base console 110, a neck portion 120, and a mounting head 130. The base console 110 can include at least one air inlet 112. The at least one air inlet 112 can be a tube or pipe, for example, that is fluidly connected to the outside of the console 110 and thus is configured to receive a stream of air from outside of the base console 110. The base console 110 can also include a fan 114. In one or more embodiments, the fan 114 can include a motor (e.g., electric or battery-powered motor) and fan blades operatively connected to the motor via a shaft, such that the fan operates as a fan blower. The at least one air inlet 112 is fluidly connected to the fan 114 such that upon operation of the motor, the fan 114 is configured to draw in the air from the air inlet and force the air upward within the neck portion 120 and subsequently into the mounting head 130 as explained in further detail below. The fan 114 can be started or initiated via an actuator (e.g., knob, button, keyboard) located on the outer surface of the base console as discussed in further detail below. In at least one alternative embodiment, the fan 114 can be located within the mounting head 130 instead of the base console 110. In this embodiment, the fan 114 in the mounting head 130, can be configured to draw the air from the air inlet 112 through the neck portion 120 and into the mounting head 130.

Figure 2:
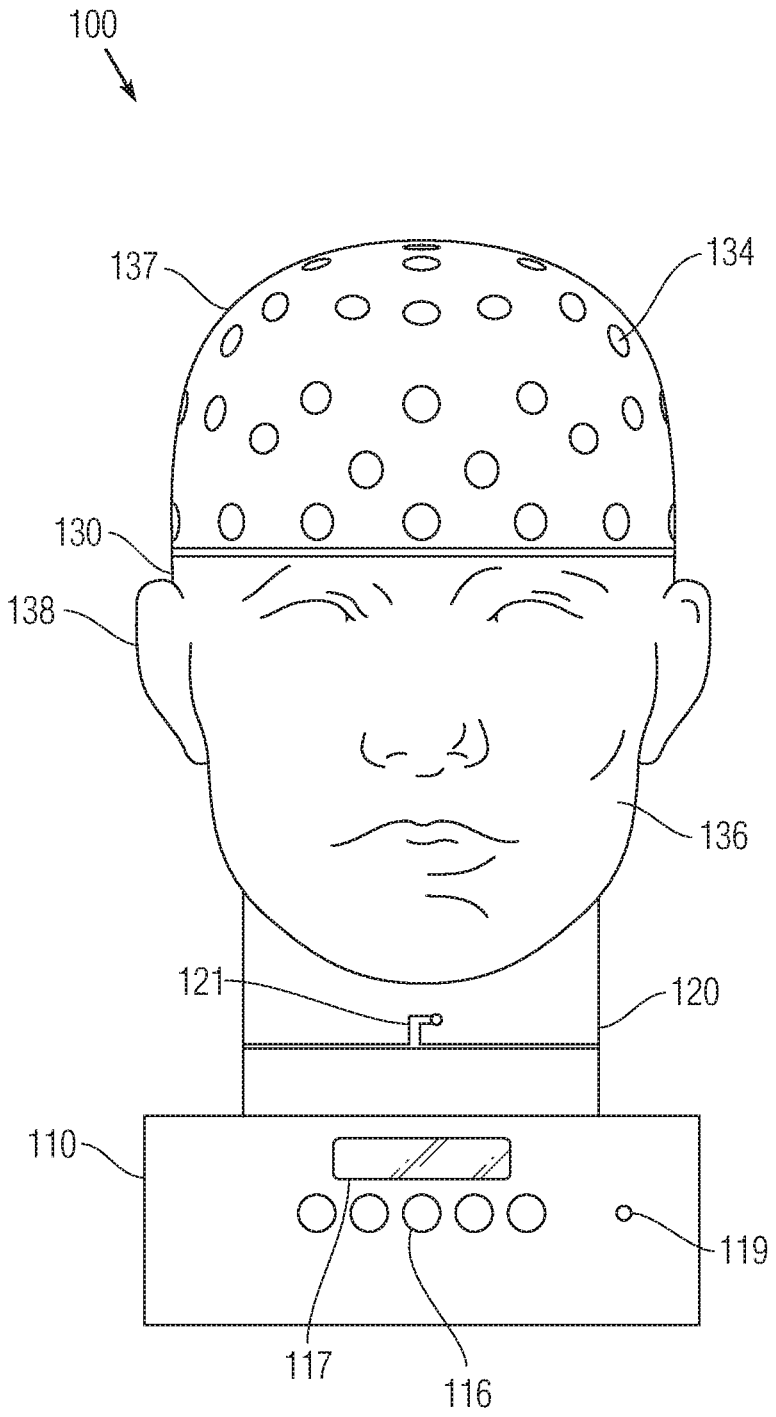
FIG. 2 shows a front view of the cap drying apparatus in accordance with one or more embodiments

In one or more embodiments, the base console 110 can also include a keyboard 116, as shown in FIG. 2 which shows a front view of the cap drying apparatus in accordance with one or more embodiments. The keyboard 116 can comprises one or more buttons or actuators, such as a power button, and can be operatively connected to an internal power source of the cap drying apparatus (e.g., battery) or an external power source (e.g., electrical power) of the cap drying apparatus via a plug. The keyboard 116 can comprises buttons and/or actuators for turning the cap drying apparatus 100 on and off, as well as button and/or actuators for adjusting the settings of the cap drying apparatus 100. For example, in at least one embodiment, the fan 114 (FIG. 1) can be operated at different speed settings, and such settings can be adjusted by the user via the keyboard 116. Additionally, there can be different drying settings (e.g., time length of drying, speed of fan) based on the type of hat to be dried. In at least one embodiment, the base console can also comprise a display 117 (e.g., display screen) configured to show settings related to the operation of the cap drying apparatus (e.g., battery power remaining, power settings of the fan, timer). In certain implementations, the display 117 can also be configured to display the time of day and/or the date, for example. In at least one embodiment, the base console 110 can further include a controller, a memory storing instructions in the form of code, and a processor (e.g., microprocessor) configured to execute the instructions, wherein the controller, memory, and processor are operatively connected to the power source, the keyboard, the display, and other circuitry of the base console. The processor, via execution of the instructions, allows the cap drying apparatus to operate at the various settings via adjustments implemented by the user via the keyboard, for example.

In at least one embodiment, the base console 110 can include a speaker 118 that can be configured to sound an alarm or play music via the radio or an attached media device. In certain embodiments, the radio can be incorporated into the base console. In at least one embodiment in which the speaker plays music, the base console can have one or more connection ports (e.g., USB port) configured to permit connection with one or more media devices (e.g., smartphone, computer) such that the sound associated with the media device can be played through the speaker of the base console. In at least one embodiment, the base console can also comprise one or more sensors 119, such as a motion sensor or a sound detector, and/or a microphone. In certain implementations, the sensor(s) 119 can be operably connected to a speaker in the base console, such that the detection of motion or sound by the sensor, for example, can trigger an alarm to sound via the speaker. In at least one embodiment, the base console can include a video camera.

In at least one embodiment, the cap drying apparatus can also be configured to act as an alarm clock which shows the time via the display located on the base console. In one or more embodiments, the base console can be configured to vibrate or play one or more predetermined sounds or recordings via the speaker, which can act as the alarm for the user, for example. The alarm sounds or vibrations can also be used in conjunction with a timer shown on a display of the base console, signaling when the cap or hat drying process is complete.

Referring again to FIG. 1, the neck portion 120 includes an air supply conduit 122 that is fluidly connected to the at least one air inlet 112. In one or more embodiments, the air supply conduit 122 is fluidly connected to the at least one air inlet 112 via the fan 114. The air supply conduit 122 can be a tube or pipe, for example. As show in FIG. 1, in at least one embodiment, the shape of the air supply conduit 122 is such that it is widest at the end that abuts the fan 114 and the air inlet 112, and tapers at its opposite end, which abuts the mounting head 130. The air supply conduit 122 is configured to receive the stream of air from the at least one air inlet 112 via operation of the fan 114. In other words, during normal operation of the cap drying apparatus 100 when the fan 114 is turned on, the fan 114 is configured to draw in the air from the air inlet 112 and force the air upward into the air supply conduit 122.

The mounting head 130 includes an inner air distribution chamber 132, and a plurality of air channels 134, which is located on an outer portion 135 of the mounting head 130. The inner air distribution chamber 132 is in fluid connection with the air supply conduit 122. The inner air distribution chamber 132 is also in fluid connection with a plurality of air channels 134. The air channels 134 are located within an outer portion of the mounting head 130 and provide a fluid connection between the inner air distribution chamber 132 and the air outside of the cap drying apparatus 100. The inner air distribution chamber 132 can receive the air stream from the air supply conduit 122 and is configured to disperse the received air stream through the plurality of air channels 134 and out of the mounting head 130. In one or more embodiments, the mounting head 130 can also comprise a face 136 and ears 138 as shown in FIG. 2, and as shown in FIG. 3, which displays a side view of the cap drying apparatus 100 in accordance with one or more embodiments.

Figure 3:
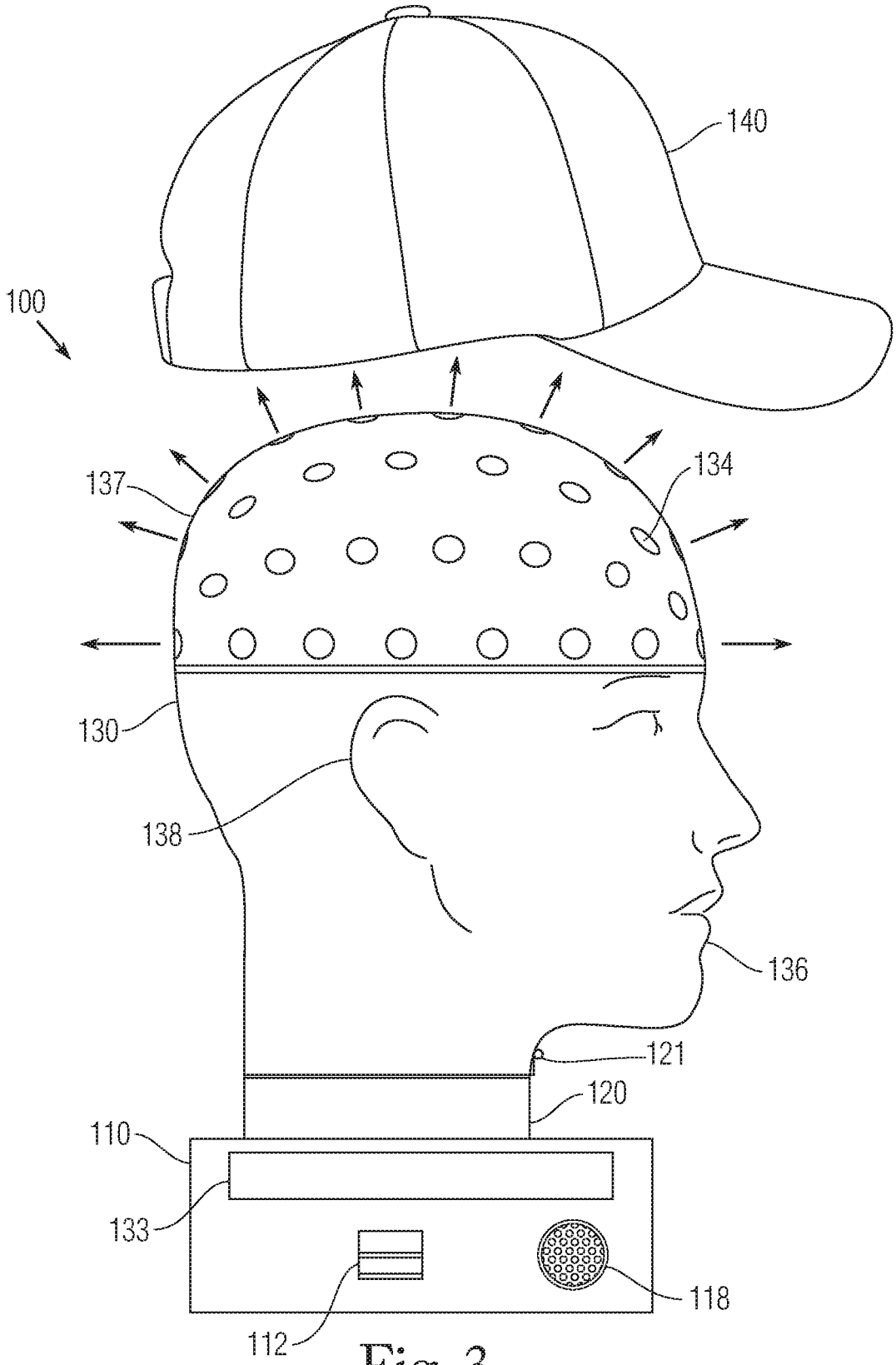
FIG. 3 shows a side view of the cap drying apparatus in accordance with one or more embodiments.
Figure 4:
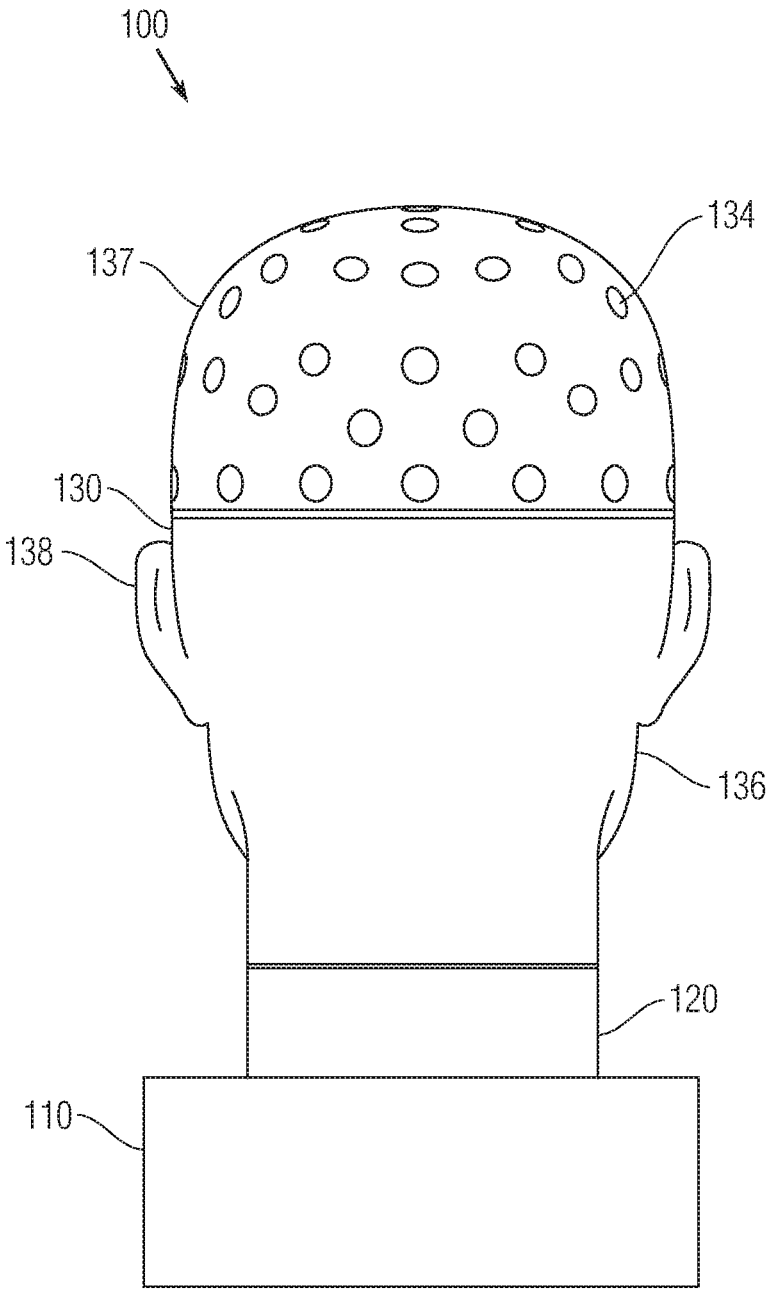
FIG. 4 shows a rear view of the cap drying apparatus in accordance with one or more embodiments.
Figure 5:
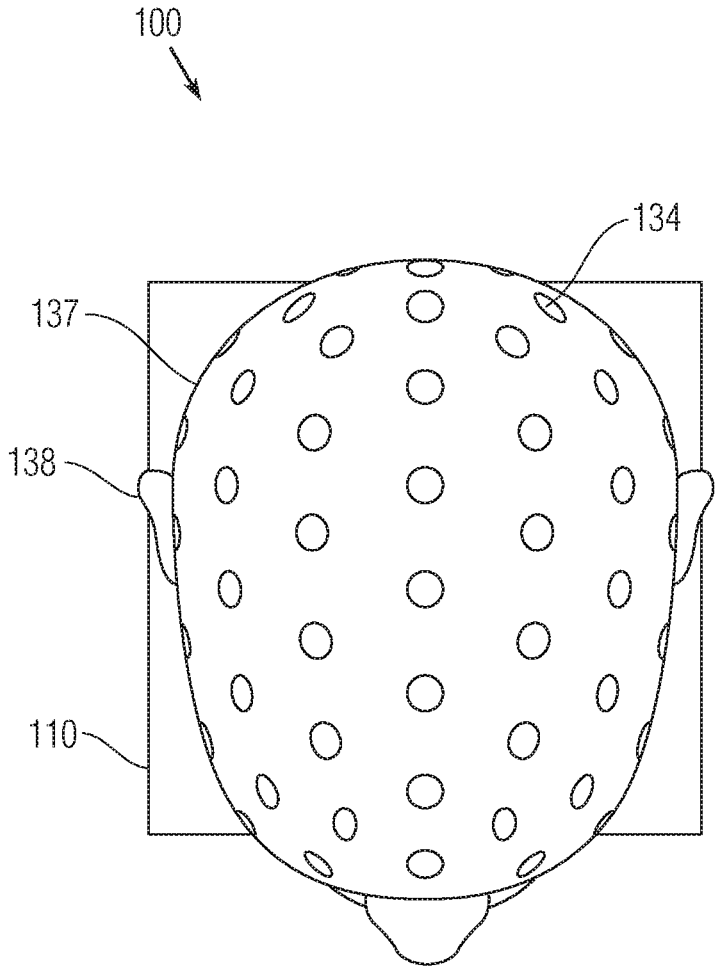
FIG. 5 shows a top view of the cap drying apparatus in accordance with one or more embodiments.

Referring now to FIG. 3, the underside of the hat 140 to be dried can securely fit or fasten on the outer surface 137 of the mounting head 130 such that the air stream disperses out of the air channels 134, contacts the hat 140 and thus dries the hat 140. The fan 114 can be configured to spin at a speed such that the air stream disperses out of the air channels 134 with enough force to quickly dry the hat, but does not force the hat to fall off the mounting head 130. FIG. 4 shows a rear view of the cap drying apparatus 100 and FIG. 5 shows a top view of the cap drying apparatus, both showing the outer surface 137 of the mounting head 130 and the air channels 134, in accordance with one or more embodiments.

In one or more embodiments, multiple mounting heads 130 having different shapes and sizes can be included with the cap drying apparatus such that hats with different shapes and sizes can securely fit on the surface of one or more of the multiple mounting heads 130. In these embodiments, the multiple mounting heads 130 can be interchanged with one another depending on the size or shape of the hat to be dried. In one or more embodiments, the one or more mounting heads 130 can be selectively detachable from neck portion 120 of the cap drying apparatus 100 such that the user can change which mounting head is on the cap drying apparatus 100 based on which of the user's hats is to be dried. For example, one mounting head can be sized for fitting a baseball cap, while a second mounting head can be sized and shaped to fit a chef's hat. In this example, the user can first attach the mounting head for securely fitting the baseball cap to dry the baseball cap. Once the baseball cap is dry, the mounting head for the baseball cap can be detached from the apparatus 100 and the mounting head for the chef's hat can be attached for drying the chef's hat. The mounting heads 130 can attach and detach from the neck portion 120 of cap drying apparatus via any number of fasteners known in the art, such as via a clasp 121, a twist and turn lock attachment, or a hook and loop fastener, for example. In at least one embodiment, the multiple mounting heads can have differing faces 136 which can be interchangeable between the mounting heads. In one or more embodiments, the interchangeable faces can be faces that resemble famous athletes, celebrities, politicians, or superheroes, for example, or faces that resemble friends or family members of the user. In one or more embodiments, the facial features of the various faces 136 (e.g., eyes, nose, hair, mouth, ears 138) can be interchangeable parts that are selectively detachable from the various mounting heads 130.

With reference to FIGS. 1-3, in at least one embodiment, the pattern of the plurality of air channels 134 on the mounting head can vary between the multiple mounting heads. For instance, a mounting head sized and shaped for a chef's hat can comprise air channels 134 in a pattern in which the majority of the air channels are near the center of the mounting head to aid in the drying of a taller, more vertically-shaped hat. In contrast, a mounting head sized and shaped for a baseball cap can comprise air channels in a pattern in which the air channels are more spread out along the surface of the mounting head to aid in the drying of a wider, flatter baseball cap.

Figure 6:
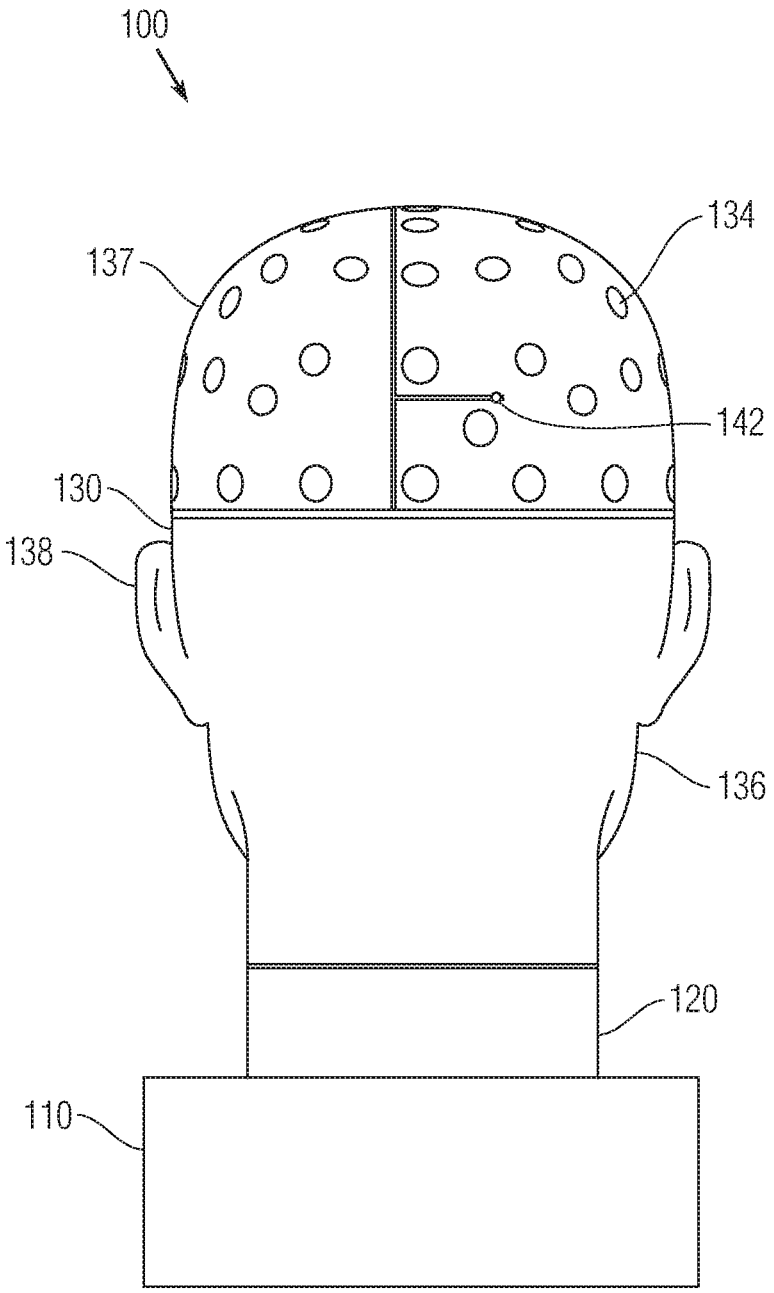
FIG. 6 shows a rear view of the cap drying apparatus having an adjustable head size in accordance with one or more embodiments.

In one or more alternative embodiments, a single mounting head 130 can be adjustable in size such that hats or caps of varying sizes can securely fit on the surface of the adjustable mounting head 130. For example, as shown in the embodiment of FIG. 6, the mounting head 130 can be expandable or contractible at a back portion of the mounting head 130 via an adjustable mechanism 142 (e.g., clasp) such that it can accommodate caps or hats of multiple sizes and such that those caps/hats securely fit on the outer surface 137 of the mounting head.

As mentioned above, during normal operation of the cap drying apparatus 100 (normal operating mode) when the fan 114 is turned on, the fan 114 is configured to draw in the air from the air inlet 112 and force the air upward into the air supply conduit 122 and subsequently into the inner air distribution chamber 132 and out of the mounting head 130 via the air channels 134. In at least one embodiment, the fan 114 can be a selectively reversible fan. In other words, in addition to its normal operating mode(s), the fan 114 can be selectively configured direct air in the opposite direction (reverse mode) such that air in the inner air distribution chamber 132 is directed downward into the air supply conduit 122 and subsequently into the one or more air inlets 112 to exit the apparatus 100. In this reverse mode, the fan 114 acts as a vacuum dryer. In one or more embodiments, the fan 114 can also be configured to run at different speeds in normal operating mode or reverse mode. The mode and the speed of the fan can be selectively adjusted by the user via the keyboard 116 or, alternatively, via one or more adjustment knobs located on the outer surface of the base console 110.

In at least one embodiment, the cap drying apparatus can operate without a fan, and thus the hat or cap is dried via thermal convection, conduction, or radiant heat transfer. In at least one embodiment in which the fan is not included, an outer portion of the air inlet can be sized and shaped to connect to a conventional hair dryer device (blow dryer), such that when the hair dryer device is turned on, heated air is directed through the air inlet 112, the air supply conduit 122, and the inner air distribution chamber 132 such that heated air is dispersed through the air channels 134 and dries the hat. In at least one embodiment that includes the fan, the fan can direct heated air through air supply conduit, air distribution chamber and out the air channels such that hat is dried. In this embodiment, the heat is introduced using a low-voltage heating or resistance coil, a low-voltage light bulb, or LED. These heat sources can be incorporated in the cap drying apparatus (e.g., within the base console 110) or can be operatively coupled to the cap drying apparatus.

In at least one embodiment, the base console can further comprise a deodorizing chamber 133 configured to receive and hold a deodorizing substance. The deodorizing chamber can comprise a drawer or a compartment that is accessible by the user via the outer surface of the base console. The deodorizing substance can comprise a liquid or solid compound, for example. Once the deodorizing substance is loaded into the deodorizing chamber 133 by the user and the chamber is closed, the chamber 133 is in fluid connection with the one or more air inlets 112 of the base console 110. Accordingly, as the air stream passes through the air inlet(s) 112 when the apparatus 100 is in normal operating mode, the air stream can entrain at least a portion of the deodorizing substance as the air stream moved into the air supply conduit. Subsequently the air stream entraining the deodorizing substance flows into the inner distribution chamber 132 and the mounting head 130 and out of the cap drying apparatus via the air channels 134. Accordingly, the entrained deodorizing substance can deodorize the hat being dried as the air stream contacts the hat after exiting the air channels 134.

In at least one embodiment, the cap drying apparatus can also include at least one light bulb 144 (see FIG. 1) located within the mounting head 130 such that when the light is turned on, the light illuminates the face 136 of the mounting head. The at least one light bulb 144 can be an LED, a standard yellow (or white) light bulb, strobe lighting, a colored light bulb, or a night light, for example.

Additional exemplary scenarios in which the cap drying apparatus can be used, in one or more embodiments, are described below.

Scenario 1: a user places a wet cap or wet hat onto the cap drying apparatus and turns on the power/start button on the base console. The cap or hat is dried within a targeted time frame.

Scenario 2: a user attaches the facial image of a favorite sports professional to the mounting head of the cap drying apparatus and then later decides to replace it and attach a different facial image—of herself—onto the mounting head. She also decides to add hair and other accessories provided with the cap drying apparatus. She decides to place and store her sunglasses onto the cap drying apparatus.

Scenario 3: a user (child or teen) walks into a room and throws or places a cap or hat onto the cap drying apparatus for storage or resting and does not turn on the air fan power. The motion detection sensor of the cap drying is on and when the user is detected, the cap drying apparatus plays a recorded greeting: "Hello, [User Name]. How was your day? I'm glad you're home!"

Scenario 4: a parent walks into the room of a user (child or teen) and discovers unwanted odors and decides to power on the cap drying apparatus air fan and to use the deodorizer feature of the cap drying apparatus to freshen the room with the deodorizing substance.

Scenario 5: a user turns on the radio of the cap drying apparatus, and then later turns on the light of the cap drying apparatus, and then sets the alarm on the display of the cap drying apparatus to wake up at 6 am the next day by vibration mode and by a selected seashore sound.

Scenario 6: a parent turns on the cap drying apparatus camera that is in the user's room (e.g., toddler children, family members needing assistance, etc.) to listen remotely or video-monitor from their bedroom or work space.

Overall, the cap drying apparatuses and methods of the present application provide an improve manner for drying the cap of the user. The present methods provide a quicker drying method than conventional methods, while maintaining the size and the shape of the cap and minimizing any damage to the fabric of the cap. In other words, the cap drying apparatus can maintain (and can restore when lost) the original form/shape of the hat or cap and can eliminate fabric wrinkles that are caused by laundering or washing. As such, the cap drying apparatus can extend the life of a cap. The cap drying apparatus can also be used on any number of different hats, regardless of shape or size.

Although much of the foregoing description has been directed to cap drying apparatuses and methods for drying a cap, the system and methods disclosed herein can be similarly deployed and/or implemented in scenarios, situations, and settings far beyond the referenced scenarios. It should be further understood that any such implementation and/or deployment is within the scope of the system and methods described herein.

It is to be further understood that like numerals in the drawings represent like elements through the several figures, and that not all components and/or steps described and illustrated with reference to the figures are required for all embodiments or arrangements. Further, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms ""including," "comprising," or "having," "containing," "involving," and variations thereof herein, when used in this specification, specify the presence of stated features, integers, steps, operations, elements, and/or components, but do not preclude the presence or addition of one or more other features, integers, steps, operations, elements, components, and/or groups thereof.

It should be noted that use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The subject matter described above is provided by way of illustration only and should not be construed as limiting. Various modifications and changes can be made to the subject matter described herein without following the example embodiments and applications illustrated and described, and without departing from the true spirit and scope of the present invention.

What is claimed:

1. A cap drying apparatus comprising:

a base console comprising at least one air inlet and a fan, wherein the at least one air inlet is configured to selectively receive an air stream from outside of the base console;

an air supply conduit fluidly connected to the at least one air inlet and configured to selectively receive the air stream via operation of the fan; and a mounting head comprising an inner air distribution chamber and an outer portion comprising a plurality of air channels, the air channels being in fluid connection with the inner air distribution chamber, wherein the inner air distribution chamber is fluidly connected to the air supply conduit and configured to receive the air stream from the air supply conduit, wherein the inner air distribution chamber is configured to disperse the received air stream through the plurality of air channels and out of the mounting head, and wherein the mounting head is sized and shaped such that a cap securely fits on its outer surface.

2. The cap drying apparatus of claim 1, wherein the mounting head is adjustable in size and shape, and configured to securely fit hats of a various sizes on the outer surface of the mounting head.

3. The cap drying apparatus of claim 1, wherein the fan is a reversible fan that is configured to either force air from the air inlet into the air supply conduit and subsequently into the inner air distribution chamber or to force air out of the inner air distribution chamber into the air supply conduit and subsequently into the air inlet.

4. The cap drying apparatus of claim 1, wherein the fan is configured to run at a plurality of different speeds.

5. The cap drying apparatus of claim 1, further comprising:

a deodorizing chamber in fluid communication with the air inlet and configured to receive a deodorizing substance, wherein the air stream passing through the air inlet entrains at least a portion of the deodorizing substance.

6. The cap drying apparatus of claim 1, further comprising a second mounting head, wherein the mounting head and the second mounting head are selectively removable from the cap drying apparatus.

7. The cap drying apparatus of claim 6, wherein the second mounting head is of a different size than the mounting head.

8. A cap drying apparatus comprising:

a base console comprising at least one air inlet and a fan, wherein the at least one air inlet is configured to selectively receive an air stream from outside of the base console;

an air supply conduit fluidly connected to the at least one air inlet and configured to selectively receive the air stream of air via operation of the fan; and a plurality of selectively removable mounting heads of varying sizes, wherein each mounting head comprises an inner air distribution chamber and an outer portion comprising a plurality of air channels, the air channels being in fluid connection with the inner air distribution chamber, wherein the inner air distribution chamber is fluidly connected to the air supply conduit and configured to receive the air stream from the air supply conduit, wherein the inner air distribution chamber is configured to disperse the received air stream through the plurality of air channels and out of the mounting head, and wherein each mounting head is respectively sized and shaped such that respective caps of varying sizes and shapes securely fit on their respective outer surfaces.

9. The cap drying apparatus of claim 8, wherein the fan is a reversible fan that is configured to either force air from the air inlet into the air supply conduit and subsequently into the inner air distribution chamber or to force air out of the inner air distribution chamber into the air supply conduit and subsequently into the air inlet.

10. The cap drying apparatus of claim 8, further comprising:

a deodorizing chamber in fluid communication with the air inlet and configured to receive a deodorizing substance, wherein the air stream passing through the air inlet entrains at least a portion of the deodorizing substance.

11. The cap drying apparatus of claim 8, wherein the fan is configured to run at a plurality of different speeds.

12. A method for drying a cap, the method comprising;

providing a cap drying apparatus, wherein the cap drying apparatus comprises:

a base console comprising at least one air inlet and a fan, wherein the at least one air inlet is configured to selectively receive an air stream from outside of the base console, an air supply conduit fluidly connected to the at least one air inlet, and a mounting head comprising an inner air distribution chamber and an outer portion comprising a plurality of air channels, the air channels being in fluid connection with the inner air distribution chamber, and the inner air distribution chamber being fluidly connected to the air supply conduit;

securely fastening a cap to the outer surface of the mounting head;

initiating the fan of the base console;

transferring, via the fan, the air stream received by the air inlet to the air supply conduit and subsequently to the inner air distribution chamber;

dispersing the air stream received by the inner air distribution chamber through the plurality of air channels; and drying the cap via the air stream that passes through the plurality of air channels.

13. The method of claim 12, further comprising:

loading a deodorizing substance into a deodorizing chamber of the cap drying apparatus, wherein the air stream entrains at least a portion of the deodorizing substance as the air stream is transferred into the air supply conduit.

14. The method of claim 12, wherein the mounting head is selectively removable, and wherein the step of providing the cap drying apparatus includes securing the mounting head to a neck portion of the cap drying apparatus, which is connected to the base console.

15. The method of claim 12, wherein the mounting head is adjustable in size, and further comprising the step of adjusting the size of the mounting head to fit a size of the cap.

* * * * *